United States Patent [19]

Havlovitz

[11] Patent Number: 4,991,716

[45] Date of Patent: Feb. 12, 1991

[54] NESTED PACKAGING ARRANGEMENT FOR HAND-PROPELLED WHEELED VEHICLES

[75] Inventor: Paul M. Havlovitz, Escondido, Calif.

[73] Assignee: Republic Tool & Mfg. Corp., Carlsbad, Calif.

[21] Appl. No.: 490,395

[22] Filed: Mar. 8, 1990

[51] Int. Cl.[5] ..... B65D 21/02

[52] U.S. Cl. ..... 206/335; 206/459; 206/518; 280/47.18

[58] Field of Search ..... 280/33.998, 47.18, 47.26, 280/47.3, 653; 206/319–321, 335, 459, 515–520

[56] References Cited

U.S. PATENT DOCUMENTS

| | | | |
|---|---|---|---|
| 4,166,531 | 9/1979 | Fujiwara | 206/320 |
| 4,640,419 | 2/1987 | Yang | 206/320 |
| 4,792,043 | 12/1988 | Holladay | 206/335 |

FOREIGN PATENT DOCUMENTS

| | | | |
|---|---|---|---|
| 2038274 | 7/1980 | United Kingdom | 206/321 |

*Primary Examiner*—Jimmy G. Foster
*Attorney, Agent, or Firm*—Harry Williams

[57] ABSTRACT

A hand cart or wheelbarrow is provided with a tub member having slanted walls, one with respect to another, together with suitably designed auxiliary members, such as a handle, wheels, axle and hardware. At the factory site the auxiliary members and hardware are placed within the tub and enveloped as a unit with a packaging material so that the resultant package is of the same general shape and configuration as the tub and contains all the elements of the complete product. In this way each package can be nested in another like package, and a plurality of such packages, so nested together, can form a compact shipping unit, storage unit or sales unit that affords maximum protection to each product and that virtually eliminates wasted space between the stacked products.

10 Claims, 2 Drawing Sheets

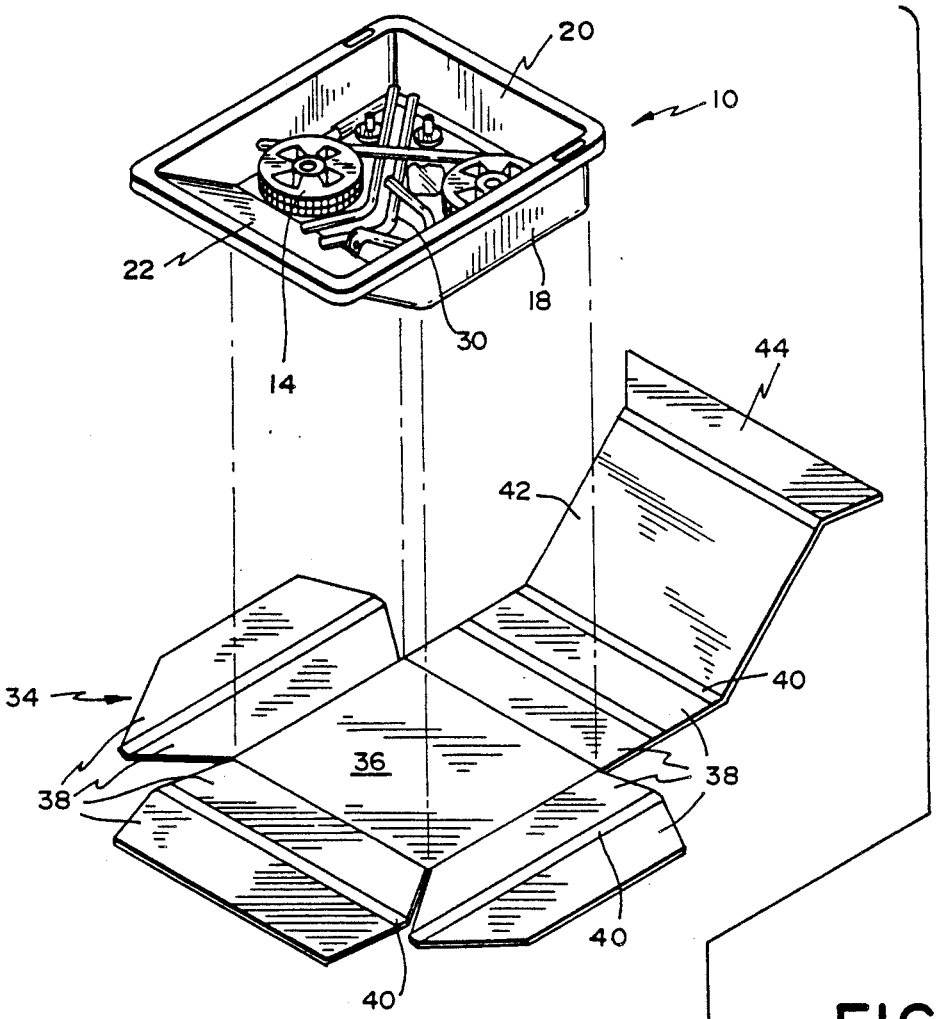
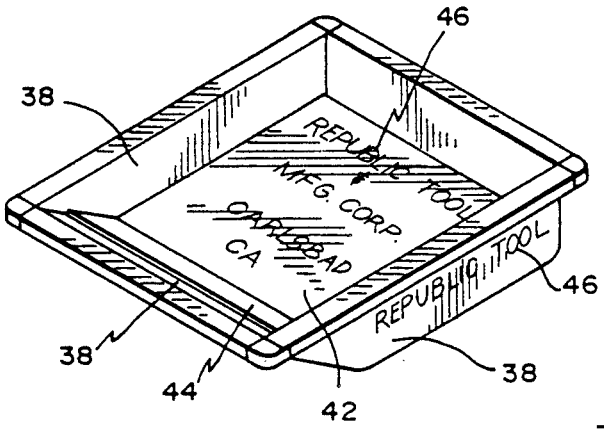
FIG. 3
FIG. 4
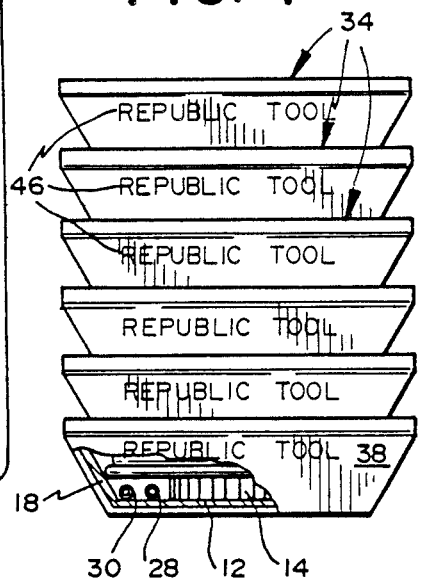

NESTED PACKAGING ARRANGEMENT FOR HAND-PROPELLED WHEELED VEHICLES

BACKGROUND OF THE INVENTION

This invention relates to a packaging arrangement for shipping and displaying hand-propelled wheeled vehicles having a tub or hopper, such as carts or wheelbarrows, which are used for transporting a load.

In shipping, warehousing and merchandising hand carts and wheelbarrows it is desirable to package such articles so that economy of space, protection of the article, and the completeness of the package contents are achieved. In the past it has been customary to package wheelbarrows and hand carts by combining the tub or hopper elements into a compact group of nested elements, while separately packaging the auxiliary members such as wheels, handles and support bars. Although this approach achieves economy of space, it produces confusion and waste by promoting the separation of interdependent elements in the shipment, warehousing and merchandising of the hand carts and wheelbarrows. In order to avoid the significant disadvantages generated by the separate packaging of components, some effort has been made to combine the tub and auxiliary elements making up the complete wheelbarrows and hand carts into single packages. But this approach invariably has resulted in bulky oversize packages that are incapable of being nested and require, therefore, an inordinate amount of space in shipment, warehousing and display on the showroom floor. A further disadvantage of this type of packaging is the overall frailty of the packaging created by the significant number of unsupported interior voids.

There is a need, therefore, to provide a packaging arrangement for hand carts and wheelbarrows which will contain all the component elements of the product, make better economic use of space during shipping, storage and display, and at the same time afford maximum protection of the entire product against damage from factory to consumer.

OBJECTS AND SUMMARY OF THE INVENTION

The present invention has for its primary object and purpose to provide a method and apparatus for packaging as single units all the elements of complete and wholly contained hand-propelled carts or wheelbarrows in which both economy of space and protection of the product is maximized during shipping, storing, and selling of the product. Other ancillary objects of the invention are the provision of a durable package for a hand-propelled cart or wheelbarrow in which there is no crushing of unsupported voids in the package. Further, through nesting of the packages according to the invention, considerable gain is achieved in freight savings, warehouse savings, sales floor savings, as well as stability in stacking. The invention further affords picture frame presentation of the graphics on the main panel of each package, as well as repetitive presentation of those graphics because of the stacking arrangement.

According to the principles of the invention, a hand cart or wheelbarrow is provided with a tub member having slanted walls, one with respect to another, together with auxiliary members including a handle, wheels, axle and hardware, such as generally shown in U.S. Pat. No. 4,889,360 and assigned to the same assignee as the present invention. According to the invention, all of the auxiliary members are separate from the tub and are so designed as to collectively and compactly fit in the bottom of the tub at the factory site before they are ultimately removed by the consumer for assembly to the tub. At the factory site the tub together with the auxiliary members and hardware placed therein are enveloped with a packaging material so that the resultant package is of the same general shape and configuration as the tub. In this way each package can be nested in another like package, and a plurality of such packages, so nested together, form a compact shipping unit, storage unit or sales unit that affords maximum protection to each product and that virtually eliminates wasted space between the stacked products.

The invention will be better understood as well as further objects and advantages thereof become more apparent from the ensuing detailed description taken in conjunction with the drawings.

BRIEF DESCRIPTION OF THE DRAWINGS

FIG. 3 is a composite schematic perspective view showing the cart according to the invention ready for packaging; and FIG. 4 is a schematic side elevation, partly broken away, of a stacked arrangement of the packages according to the invention.

DETAILED DESCRIPTION

Figure 1:
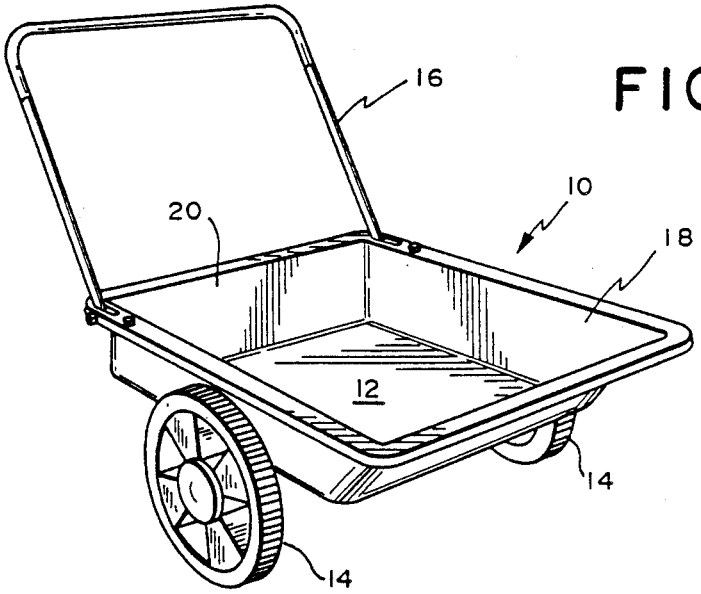
FIG. 1 is a schematic perspective view of the assembled hand cart used with the present invention.

Referring now to FIG. 1, there is shown an assembled hand cart 10 having a tub or hopper 12, a pair of wheels 14 and a handle member 16. The tub is seen to comprise a pair of opposed sidewalls 18 and a pair of endwalls 20, each of which are slanted to a suitable degree, one with respect to the other. It is important that there is this slanted relationship between the walls of the tub so that one tub can be nested within another, as more fully explained below.

Figure 2:
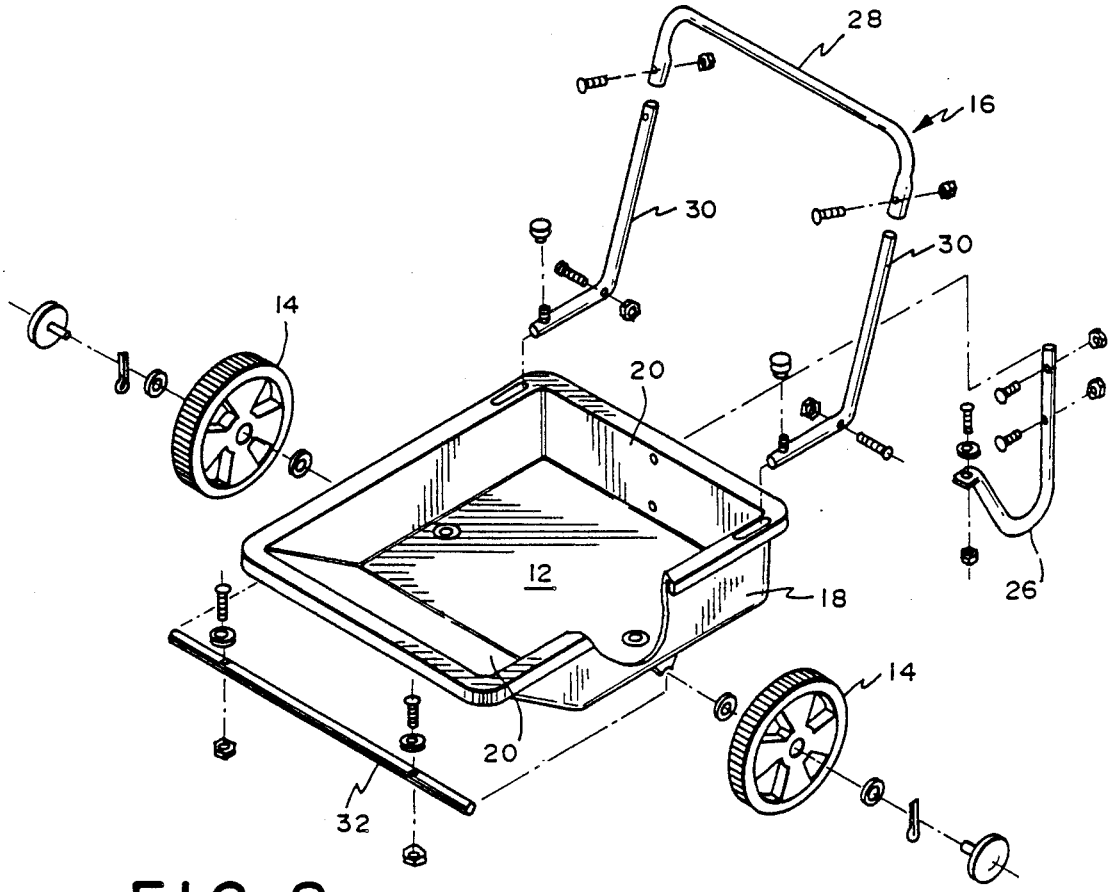
FIG. 2 is a schematic perspective view of the hand cart before it is assembled with the various auxiliary members shown in explosion.

In FIG. 2 the same cart is illustrated with the auxiliary members to the tub 12 shown separated from the tub, as would be the case before the cart is assembled. Specifically, a support member 26 is shown for attachment to the tub 12 by conventional nut and bolt means. The handle member 16 is shown comprising a horizontal member 28 and a pair of vertical members 30. These members are sized so that each one fits or contacts the floor of the tub 12. An axle 32 for supporting the wheels 14 is also designed to traverse a diagonal dimension of the floor of the tub. It is also contemplated that the auxiliary members could be placed on the outside surface of the bottom panel of the tub and, of course, held there by suitable adhesive means to thereby allow the same nesting relationship between the tubs. It is preferred, however, that the auxiliary members be placed within the interior of the tub.

As illustrated in FIG. 3, the tub 12 is shown to have the various auxiliary members mentioned above snugly positioned on the floor of the tub, including the wheels 14, hubs and a suitable package of hardware, such as bolts, nuts, cotter pins etc., for securing the auxiliary members to the tub after shipment and sale. Once the auxiliary members are in place on the floor of the tub, there is sufficient room above the topmost plane of the auxiliary members to allow nesting of one tub within another. Towards this end, a suitable packaging material, corrugated paper, cardboard, or plastic wrap, such as shown at 34 and comprising a bottom panel 36, wall panels 38 and a top panel 42.

Once the tub 12 is placed on the bottom panel 36, the remainder of the packaging material is folded over the tub by means of the folds 40 so that the top panel 42 rests just slightly above the auxiliary members positioned on the floor of the tub. The end flap 44 is suitably attached, either by adhesive means or staples, to the appropriate inside endwall panel 38, as are the remaining end flaps 38 to the edges of the top panel 42. In this way the tub 12 together with the auxiliary members placed therein are completely enveloped by the packaging material 34. Of course, it should be understood that the packaging material 34 need not completely envelop the tub 12, it being only necessary to envelop enough of the tub to insure that the same is soundly supported by the packaging material, that the auxiliary members are secured therein and that the packaging material acts to separate one tub from another when the packages are stacked or nested together. It will be seen from the above that the package 34, thus formed, is of the same general shape and configuration as the tub 12, and for this reason each package 34 can be nested in another like package to form a stack of such packages, such as shown In FIG. 4.

Also shown in FIG. 3 is graphic material 46 printed on the outside surface of panel 42, as well as on one or all of the sidewalls 38 of each package 34. This graphic material may comprise an advertising slogan, the name of the manufacturer of the hand cart, or a picture of the hand cart when it is assembled, such as shown in FIG. 1. It will be understood that the graphic material 46 will always be visible from the top of the stack of packages 34, as shown in FIG. 4. The graphic material printed on one or all of the sidewalls 38, however, is positioned so that it is always visible in a repetitive form from the side of the nested packages, as shown in FIG. 4.

The foregoing relates to preferred exemplary embodiment of the present invention, it being understood that other embodiments and variants thereof are possible within the scope of the invention, the latter being defined by the appended claims.

What is claimed and desired to be secured by Letters Patent of the U.S. is:

1. A packaging arrangement for a hand-propelled load carrying vehicle, comprising a tub means defining a tub having slanted sidewalls, one with respect to another, an auxiliary means defining auxiliary portions of said vehicle including wheel means defining a wheel and handle means defining a handle separate from said tub means, said auxiliary means being disposed in a generally planar configuration at a bottom-most portion of the interior of said tub means, and a packaging means substantially enveloping said tub means and said auxiliary means, thereby defining a package having the same general shape and configuration as said tub means, whereby one said package can be nested within another said package.

2. A packaging arrangement according to claim 1, wherein said packaging means comprises a paper products for covering both the inside surfaces of said tub means and the outside surfaces of said tub means and having planes generally corresponding to the planes defining said tub means.

3. A packaging arrangement according to claim 1, wherein said packaging means includes a panel means defining a panel overlying said auxiliary means.

4. A packaging arrangement according to claim 3, wherein said panel means is provided with graphic material thereon, whereby said graphic material is always visible on the topmost package of a stacked arrangement in which said one package is nested within said another package.

5. A packaging arrangement according to claim 1, wherein said auxiliary means includes means for assembling said auxiliary means to said tub means.

6. A packaging arrangement according to claim 1, wherein said auxiliary means disposed in said tub means defines a top planar surface substantially below the planar surface defined by the tops of said sidewalls.

7. A packaging arrangement according to claim 1, wherein said handle means comprises articulated sub members, whereby when said sub-members are disassembled they collectively fit within said bottom-most portion of said tub means.

8. A method for packaging a hand-propelled load carrying vehicle having a tub means defining a tub including slanted sidewalls, one with respect to another, and separate auxiliary means defining auxiliary portions of said vehicle including a wheel means defining a wheel and a handle means defining a handle, comprising the steps of placing said auxiliary means in a generally planar configuration in the bottom-most portion of the interior of said tub means, and enveloping said tub means and said auxiliary means with a packaging material, thereby defining a package having the same general shape and configuration as said tub means, whereby one said package can be nested within another said package.

9. A packaging arrangement for a hand-propelled load carrying vehicle, comprising a tub means defining a tub, an auxiliary means defining auxiliary portions of said vehicle including wheel means defining a wheel and handle means defining a handle, said auxiliary means being disposed in a generally planar configuration adjacent a bottom wall of said tub means, packaging means substantially enveloping said tub means and said auxiliary means, thereby defining a package whereby one said package can be nested within another said package, and graphic material disposed on a portion of an outside sidewall of said package and visible in a repetitive form when one said package is nested within another said package.

10. A packaging arrangement for a hand-propelled load carrying vehicle, comprising a tub means defining a tub having at least one slanted sidewall, an auxiliary means defining auxiliary portions of said vehicle including wheel means defining a wheel and handle means defining a handle, said auxiliary means being disposed in a generally planar configuration adjacent a bottom wall of said tub means, and a packaging means substantially enveloping said tub means and said auxiliary means, thereby defining a package whereby one said package can be nested within another said package.

* * * * *